US011375778B1

(12) United States Patent
Zinnbauer

(10) Patent No.: US 11,375,778 B1
(45) Date of Patent: Jul. 5, 2022

(54) BUCKLE WITH SECONDARY LATCH

(71) Applicant: Gerald Boyd Zinnbauer, Cornelius, NC (US)

(72) Inventor: Gerald Boyd Zinnbauer, Cornelius, NC (US)

(73) Assignee: Yellow Dog Design, Inc., Greensboro, NC (US)

( * ) Notice: Subject to any disclaimer, the term of this patent is extended or adjusted under 35 U.S.C. 154(b) by 0 days.

(21) Appl. No.: 17/090,155

(22) Filed: Nov. 5, 2020

Related U.S. Application Data

(60) Provisional application No. 63/103,862, filed on Aug. 31, 2020.

(51) Int. Cl.
*A44B 11/25* (2006.01)

(52) U.S. Cl.
CPC ..... *A44B 11/2515* (2013.01); *A44B 11/2592* (2013.01)

(58) Field of Classification Search
CPC ..... A44B 11/2515; A44B 11/2592
See application file for complete search history.

(56) References Cited

U.S. PATENT DOCUMENTS 1,807,293 A * 5/1931 Keller ..... A44C 5/2042 24/616
2,956,324 A * 10/1960 Klein ..... A44B 11/2596 24/323
4,100,657 A * 7/1978 Minolla ..... A44B 11/2511 24/642
4,406,043 A * 9/1983 Friedman ..... A44B 11/006 24/171
4,563,797 A * 1/1986 Kawai ..... A44B 11/2515 24/637
4,648,161 A * 3/1987 Rosen ..... A44C 5/2085 24/587.11
5,671,516 A * 9/1997 Sartori ..... A44B 11/2515 24/579.11
6,389,653 B1 * 5/2002 Matoba ..... A44B 11/006 24/265 AL
7,480,967 B2 * 1/2009 Kojoori ..... A44B 11/006 2/322
8,065,781 B2 * 11/2011 Chao ..... A61B 17/1327 24/70 ST
9,173,454 B2 * 11/2015 Liu ..... A44B 11/006
9,599,133 B2 * 3/2017 Gordon ..... A44C 5/2085
9,930,936 B2 * 4/2018 Liu ..... A44B 11/006
11,096,454 B2 * 8/2021 Wang ..... A44B 11/2592
2011/0283493 A1 * 11/2011 Virgen ..... A44B 11/2576 24/593.1

* cited by examiner

*Primary Examiner* — Jason W San
(74) *Attorney, Agent, or Firm* — Tuggle Duggins P.A.; Blake P. Hurt

(57) ABSTRACT

A two-component buckle having a male component and a female component, the female component having a housing with a bore located at a mating end of the housing, the bore being oriented along a lateral axis of the housing; and the male member having a keeper element that fits within the bore to latch the male and female components together is disclosed herein. A latching mechanism is slidingly disposed within the housing and includes a latch pawl with a latching leg that is biased over the bore in the housing, serving as a secondary latch to help prevent the keeper element from being inadvertently disengaged from the bore.

20 Claims, 3 Drawing Sheets

BUCKLE WITH SECONDARY LATCH

This non-provisional patent application claims all benefits under 35 U.S.C. § 119(e) of U.S. provisional patent application Ser. No. 63/103,862 filed 31 Aug. 2020, entitled "UNIVERSAL BUCKLE", in the United States Patent and Trademark Office, which is incorporated by reference in its entirety herein. Additionally, any and all other provisional patent applications filed by the instant inventor, regardless as to whether they are pending or not, are similarly incorporated by reference in their respective entireties herein.

FIELD OF THE INVENTION

The invention herein pertains to a buckle, and more particularly pertains to a buckle having a keeper that is engaged with a mating member in a transverse orientation in addition to a secondary latching mechanism.

DESCRIPTION OF THE PRIOR ART AND OBJECTIVES OF THE INVENTION

A buckle as generally thought of is a type of fastener used to releasably engage two (or more) lengths of material together, or two (or more) ends of a single length of material. Buckles are widely used on a diverse group of items such as, but not limited to, handbags, belts, shoes, luggage, straps, backpacks, briefcases, animal collars, watch bands and numerous other items.

Despite the numerous different buckle designs in the art, they generally fall into one of two basic categories: buckles that have only one functional component and buckles that have two functional components that mate together. Examples of the former include a typical belt buckle, for example, which might consist of a closed frame (typically in the shape of a rectangle, square or D-shape) with a centrally located tang or prong that is pivotally attached to the frame. The frame is fixed to one end of a web of material and the other end of material is passed through the frame and secured with the tang or prong, typically by inserting the tang into a predetermined opening in the web. A variation, often seen in western wear, has a large plate with a fixed prong on the back. The web of material is passed through a loop at the back of the plate and secured by placing the fixed prong into an opening in the web. Traditional military style belt buckles have a frame with a pin that moves in slots in the frame. The web of belting is passed between the pin and the frame. When tension is applied to the web, the web is captured between the pin and the frame. In each of these designs, only one end of the web has a functional component used to secure the web in place.

By contrast, two-component buckles are used in applications such as seat belts, safety harnesses, packs, messenger bags, tactical gear, etc. Two-component buckles have two mating components, one attached to each end of webbing. The mating components lock in place when brought together in mating engagement. A device such as a button, latch or spring detent is activated to release the buckle components from each other. In most of the two-component buckle designs, tension applied to the strap or webbing is transmitted directly to the latching mechanism keeping the parts connected together. These parts of the latch mechanism are often moving parts and the stress placed on them weakens the latch components. Moreover, many of the mechanisms used to unlatch the buckle are subject to inadvertent activation, which can cause unintentional release of the buckle components.

Thus, there is a need for a two-component buckle design that, when tension is applied to the web, transmits the force to more robust or structurally robust portions of the buckle. There is also a need for a two-component buckle design that helps to eliminate inadvertent opening of buckle components.

Thus, in view of the problems and disadvantages associated with prior art devices, the present invention was conceived and one of its objectives is to provide a two component buckle having a more robust connection means for the reduction of stress on the latching components.

It is another objective of the present invention to provide a two component buckle having a more robust connection means to prevent inadvertent activation.

It is still another objective of the present invention to provide a two component buckle having first and second latching mechanisms for stronger securement.

Various other objectives and advantages of the present invention will become apparent to those skilled in the art as a more detailed description is set forth below.

SUMMARY OF THE INVENTION

The aforesaid and other objectives are realized by providing, a two-component buckle having a male component and a female component adapted for mating engagement with one another. The female component has a longitudinal axis and a channel opening oriented transverse to the longitudinal axis. The male component has a keeper protrusion that fits within the channel in the female component as a primary mechanism to secure the male and female components together. Contained within the female component is a latching mechanism that has a latch pawl and a latching leg. The latch mechanism is biased toward the channel opening by a spring and the latching leg partially covers the channel opening to prevent the keeper protrusion from falling out during use. The latching mechanism also has an actuator that removes the latching leg from the channel opening upon urging of the actuator.

DETAILED DESCRIPTION OF THE PREFERRED EMBODIMENT AND OPERATION OF THE INVENTION

Figure 1:
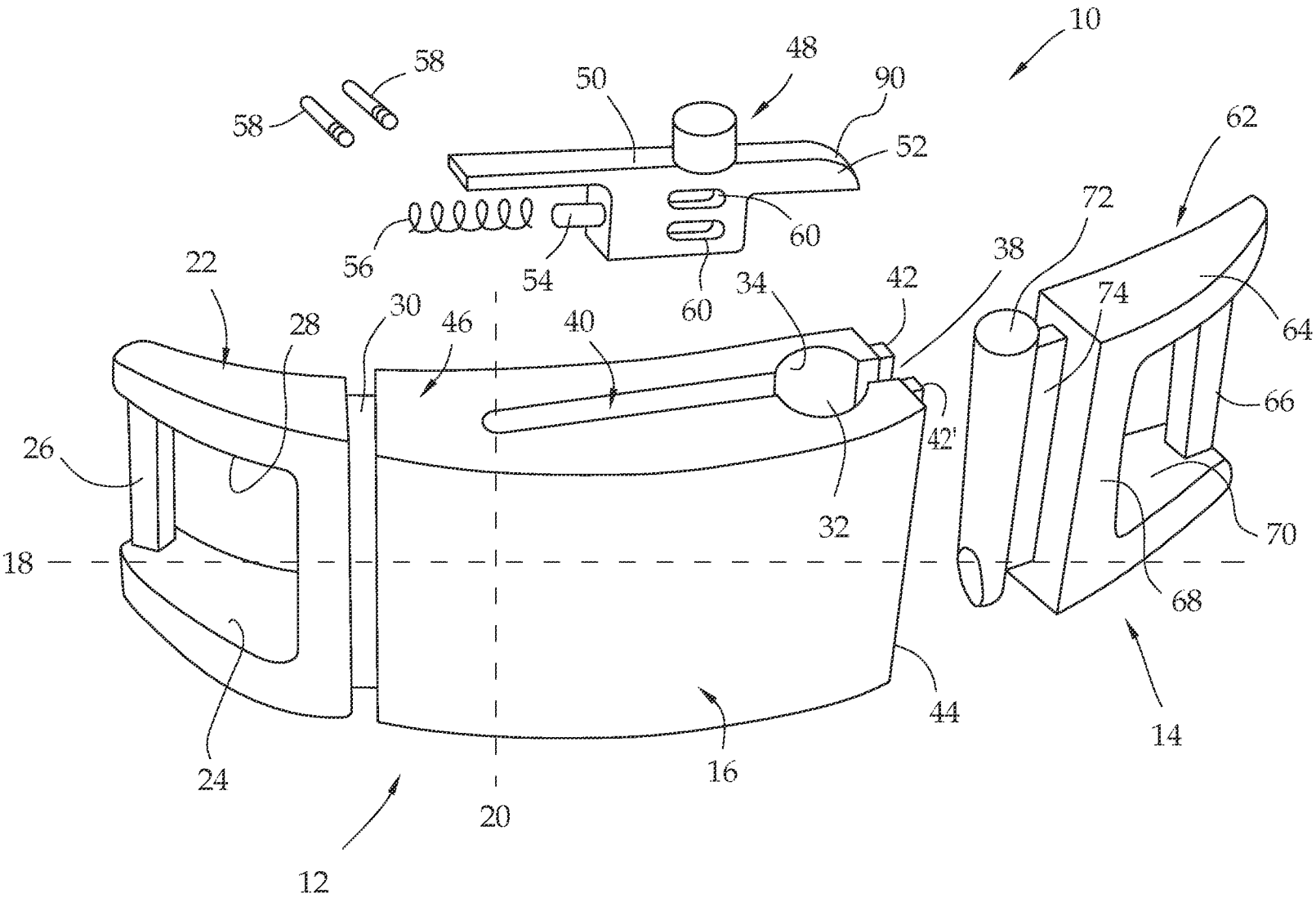
FIG. 1 is an exploded perspective view of a preferred embodiment of the two-component buckle according to the invention.
Figure 2:
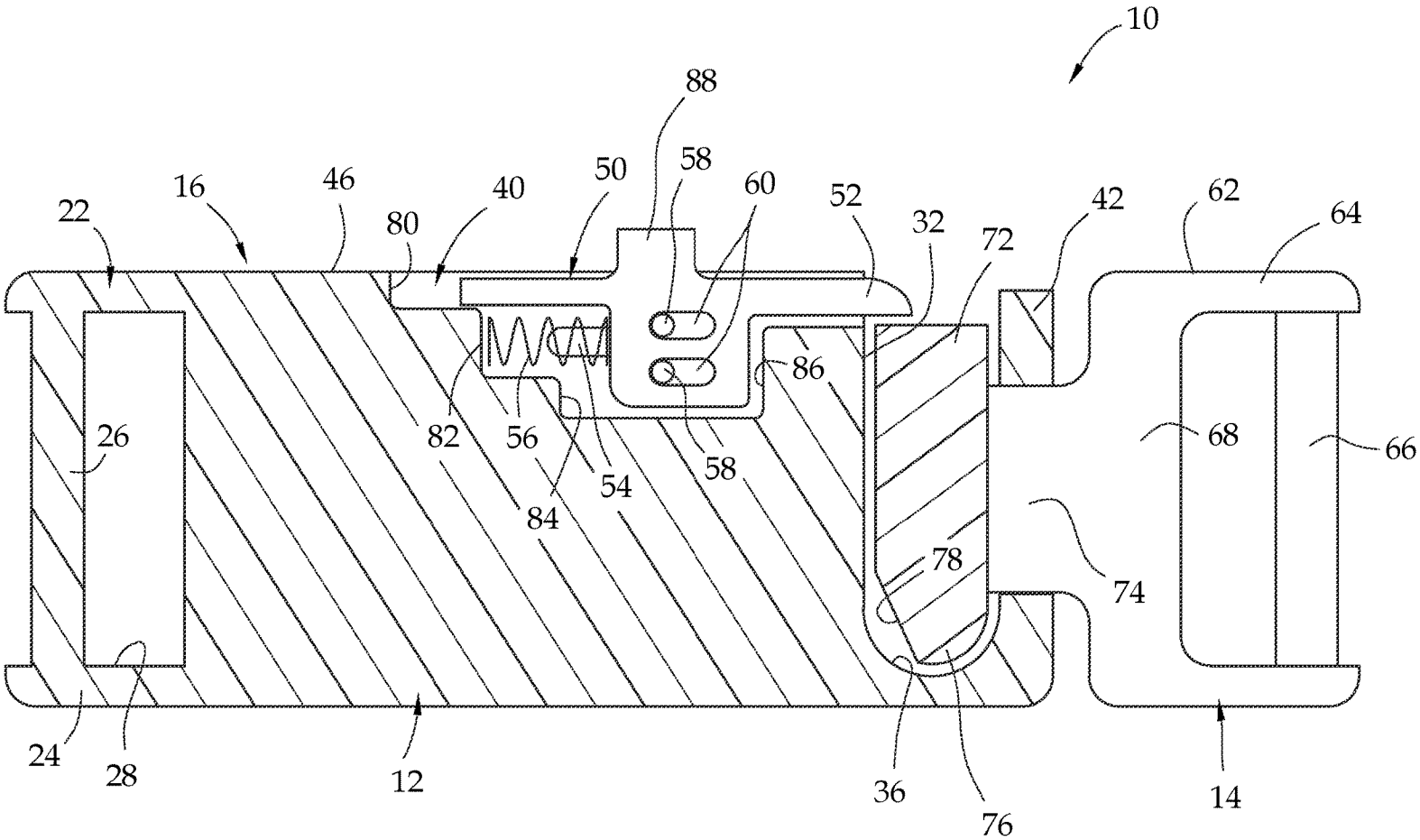
FIG. 2 is a sectioned view of a preferred embodiment of the two-component buckle of the invention, shown in a latched condition.

For a better understanding of the invention and its operation, turning now to the drawings, FIGS. 1 and 2 illustrate a preferred embodiment of the two-component buckle of the invention. The buckle 10 comprises a female component 12 and a male component 14. As will be explained in more detail below, the female component 12 and the male component 14 can engage and release to fasten and unfasten the buckle 10.

The female component 12 has a housing 16. The housing 16 has a longitudinal axis 18 and a lateral axis 20 oriented generally perpendicular to one another. A yoke 22 is provided at one end of the housing 16. The yoke 22 has a frame 24 attached to the housing and a keeper bar 26. The keeper bar 26 is oriented parallel to the lateral axis 20 of the housing 16 and is spaced from the housing 16 to create an opening 28 between the keeper bar 26 and the housing 16. The yoke 22 provides a point of attachment for the housing to be affixed to a web of material. In particular, a web of material (not shown) may be looped through the opening 28 and around the keeper bar 26 and secured, thus attaching the housing to the web. In the embodiment shown in FIG. 1, the yoke 22 is connected to the housing 16 by a bridge section 30, which has smaller exterior dimensions compared to either the yoke 22 or the housing 16 and provides a distinctive visual design element. However, the use of such a bridge 30 is not a necessary element of the invention.

Figure 3A:
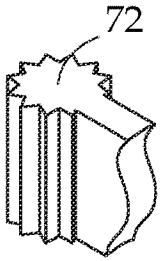
FIGS. 3A through 3H depict alternative embodiments of one or more portions of the two-component buckle according to the invention.
Figure 3B:
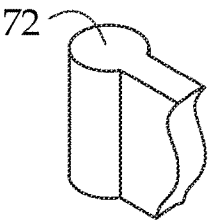
Figure 3C:
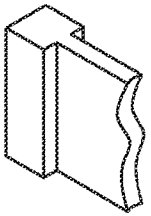
Figure 3D:
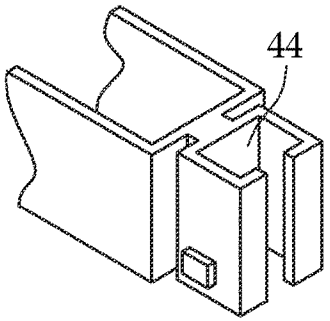
Figure 3D:
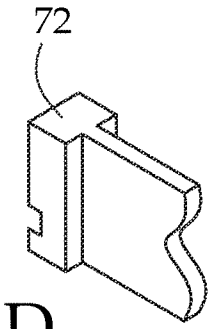
Figure 3E:
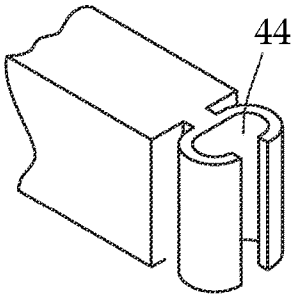
Figure 3E:
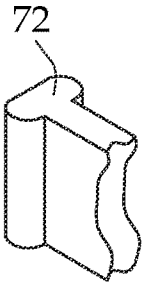
Figure 3F:
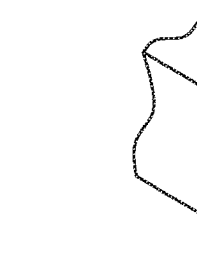
Figure 3G:
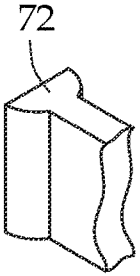
Figure 3H:
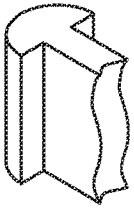

A closed end bore 32 is provided at the mating end 44 of the housing 16 remote from the yoke 22. The term "closed end bore" means that the bore is not a through bore, but rather has an open end 34 and a closed end 36 (see FIG. 2). The bore 32, in the embodiment shown, has a generally cylindrical configuration with a generally circular cross-section configuration. The longitudinal axis of the cylindrical bore 32 is oriented parallel to the longitudinal axis 20 of the housing 16. It should be noted that alternative embodiments of end bore 32 are contemplated within the scope of the instant invention, and while the closed end bore 32 described above is preferred, embodiments such as those depicted in FIGS. 3D, 3E, and 3F (or others) may be desirable as well.

Closed end bore 32 is in fluid communication with two separate channels—a parallel channel 38 and a transverse channel 40. The parallel channel 38 is oriented parallel to the longitudinal axis of the bore 32 and lateral axis 20. The parallel channel 38 defines a slotted opening on the mating end 44 of the housing 16. A pair of protrusions 42, 42 are disposed on mating end 44 of housing 16, with one protrusion 42 disposed on either side of the slotted opening defined by parallel channel 38.

The transverse channel 40 is oriented perpendicular to the longitudinal axis of the closed end bore 32 and parallel to the longitudinal axis 18 of the housing 16. Transverse channel 40 is in fluid communication with the top 46 of housing 16. A latch mechanism 48 is disposed within the transverse channel 40. The latch mechanism 48 has a latch pawl 50, which is an irregular shaped member with a latching leg 52 extending therefrom. The latch pawl 50 has a boss 54 extending from a rear surface thereof. A coil spring 56 fits over the boss 54 to bias the pawl 50 toward the mating end 44 of housing 16.

Latching mechanism 48 is disposed within the transverse channel 40 for sliding movement between locked and unlocked positions, the locked position being shown in FIG. 2. A pair of pins 58, 58 fit within corresponding slots 60, 60 in the pawl 50 to secure the pawl 50 within the transverse channel 40, yet still permit sliding movement of the pawl 50 within the transverse channel 40.

Transverse channel 40, as seen in FIG. 2, has a series of shoulders, providing transverse channel 40 with a step-like configuration. The first shoulder 80, is located at the upper end of transverse channel 40 and adjacent to the top 46 of housing 16. First shoulder 80 limits the rearward movement of pawl 50. The second shoulder 82 is located just below first shoulder 80 and engages with the coil spring 56 to bias the pawl 50 and latching leg 52 toward the parallel channel 38 in mating end 44. The third shoulder 84 is located just below second shoulder 82 and also limits the rearward movement of the pawl 50. A forward wall 86, located opposite the third shoulder 84, limits the forward movement of the pawl 50. Pins 58 riding in slots 60 further define the forward and rearward sliding movement of pawl 50 within the transverse channel 40.

Additionally, or in the alternative, a modification to latching leg 52 may be made such that an alternative embodiment of the protrusion is configured (i.e. sized and shaped) to be received within a corresponding notch (by way of example, but not intended as a limitation, in embodiments of keeper element 72), such that the horizontal displacement of pawl 50 is limited as described above, but the vertical displacement is similarly limited, particularly in an instance where pins 58 may be insufficient to otherwise restrict said vertical displacement (not shown).

The male component 14 of buckle 10 has a yoke 62 having a U-shaped frame 64 and a transverse keeper bar 66. The keeper bar 66 is spaced from and parallel to the vertical leg 68 of the yoke 62, defining an opening 70 between the transverse keeper bar 66 and the vertical leg 68. The yoke 62 provides a point of attachment for the male component 12 to be affixed to a web of material. In particular, a web of material (not shown) may be looped through the opening 70 and around the transverse keeper bar 66 and secured, thus attaching the male component 14 to the web.

Attached to the vertical leg 68 of frame 64 and remote from the keeper bar 66 is a keeper element 72. The keeper element 72 is attached to the yoke 62 by way of a bridge element 74 formed between the keeper element 72 and the vertical leg 68 of the frame 64. The bridge element 74 is narrower and shorter in dimensions than the vertical leg 68 and the keeper element 72. In the embodiment shown, the keeper element 72 is a generally cylindrical member oriented parallel to the vertical leg 68 of the frame 64. The cross-sectional size and shape of the keeper element 72 is selected to match the cross-sectional size and shape of the closed end bore 32 in the housing 16 of female component 12. To facilitate insertion and removal of keeper element 72 into closed end bore 32, the bottom end 76 of keeper element 72 may be provided with an angled face 78.

To mate the female component 12 of the latch 10 with the male component 14, the bottom end 76 of keeper element 72 is placed at the opening of the closed end bore 32 and the keeper element 72 is inserted into the bore 32. To facilitate the insertion of the keeper element 72, the pawl 50 may be moved rearward to move latching leg 52 away from the opening of the bore 32 by applying pressure against actuator knob 88. This is particularly necessary if the latching leg 52 covers substantially the entire opening of closed-end bore 32 at the top 46 of housing 16. However, if the latching leg 52 only partially covers the opening of the bore 32, as shown in FIG. 2, the act of inserting the keeper element 72 will cause the angled face 78 to contact with the latching leg 52 and force the latching leg 52 and pawl 50 to move against the bias of coil spring 56 and permit the keeper element 72 to be inserted into the bore 32. Latching leg 52 may be provided with a rounded upper surface 90 as shown in FIG. 2 to facilitate the rearward movement of latching pawl 50.

When the keeper element 72 is being inserted into the bore 32, the bridge element 74 will be located within the parallel channel 38 and sandwiched between the protrusions 42 located on either side of parallel channel 38. Once the keeper element 72 is fully inserted into the closed end bore 32, the coil spring 56 will bias the pawl 50 and latching leg 52 forward, placing the latching leg 52 over the opening of bore 32 and preventing keeper element 72 from being inadvertently disengaged from the bore 32. To release the buckle, one must apply pressure to the actuator knob 88 to move the pawl against the bias of spring 56 to move the latching leg 52 away from the opening of the bore 32. Once the latching leg 52 no longer obstructs the opening of bore 32, the keeper element 72 can be removed from the bore and buckle is unlatched.

One or more alternative embodiments of mating end 44 or bore 32 and keeper element 72 are illustrated in FIGS. 3A-3H. Although not exhaustively illustrated herein, it is intended that the structure and geometry of the respective keeper element 72 would substantially and cooperatively correspond with the associated mating end 44 of said bore 32. Additionally, or in the alternative, it should be noted that bore 32, previously described above as "closed" bore 32, may in fact define a structure and geometry not only varied in shape, but also varied in terms of openness—which is to say that that open or through bore embodiments are contemplated within the scope of the instant invention as desirable.

The male and female components of the buckle may be formed from any suitable material, including synthetic polymers such as nylon, polycarbonate, ABS, etc. or from metals such as steel, aluminum, brass, bronze, etc. Techniques to form the components from such materials are well known to those skilled in the art, including injection molding, machining, casting, etc. The construction of the buckle permits to introduction of numerous design and ornamental features, such as graphics, colors, shapes, glow in the dark features, etc.

The embodiments shown in the preceding description are for illustration only and are not intended to limit the scope of the invention. For example, in the embodiments, the housing of the female component is shown with a slight curvature. If the intended use of the buckle is on a belt, having a slight curvature of the components to correspond to the curvature of the abdomen may enhance comfort of the user. However, if the application of the buckle is for a bag or pack, the curvature of the components is generally not considered advantageous. Similarly, the keeper element and closed end bore are illustrated as having a generally circular cross-sectional shape. It is understood that, as long as the cross-sectional shape of these two features permits mating engagement, the actual cross-sectional shape is irrelevant. Thus, the cross-sectional shape can be circular, polygonal, star shaped, semi-circular or other desired shape. Similarly, while the embodiments shown utilize a closed end bore, it is also possible to use a through bore, with appropriate modifications (for example, an internal pin or stop member) to prevent the keeper element from passing completely through the bore.

The illustrations and examples provided herein are for explanatory purposes and are not intended to limit the scope of the appended claims.

I claim:

1. A buckle comprising a female component and a male component; the female component including a housing with a mating end; said mating end defining a bore oriented parallel to a lateral axis of the housing; the male component further comprising an elongated keeper element that fits within the bore to maintain the male and female components together; said housing further comprising a latch mechanism, said latch mechanism including an actuator and a latch pawl with a latching leg extending from the latch pawl; wherein said latch mechanism is configured to be biased toward the bore so that the latching leg at least partially covers an opening of the bore, sized and shaped to receive the elongated keeper member therein; wherein said latch mechanism is configured to urge the actuator to uncover the opening to facilitate the insertion or removal of the elongated keeper member.

2. The buckle of claim 1, wherein the housing defines a longitudinal axis oriented perpendicular to the lateral axis; wherein said housing further comprises a yoke including a frame and a keeper bar, the keeper bar spaced from the housing and oriented perpendicular to the longitudinal axis of the housing, said yoke comprising an attachment point for a web of material.

3. The buckle of claim 1, wherein the housing defines a longitudinal axis oriented perpendicular to the lateral axis; wherein said housing further comprises a yoke having a frame and a keeper bar, the keeper bar spaced from the housing and oriented perpendicular to the longitudinal axis of the housing, said yoke comprising an attachment point for a web of material; and wherein the yoke is connected to said housing by a bridge section.

4. The buckle of claim 1, wherein the bore comprises a cylindrical opening with one closed end.

5. The buckle of claim 1, wherein the bore comprises a cylindrical opening with one closed end, said bore defining a longitudinal axis oriented parallel to the lateral axis of the housing; wherein said bore is in fluid communication with a parallel channel and a transverse channel; said parallel channel oriented parallel to the longitudinal axis of the bore and defining a slotted opening on a mating end of the housing.

6. The buckle of claim 1, wherein the bore defines a cylindrical opening with one closed end, said bore including a longitudinal axis oriented parallel to the lateral axis of the housing; wherein said bore is in fluid communication with a parallel channel and a transverse channel; wherein said transverse channel is oriented perpendicular to the longitudinal axis of the bore, said transverse channel being open at a top surface of said housing.

7. The buckle of claim 1, wherein the bore defines a cylindrical opening with one closed end, said bore including a longitudinal axis oriented parallel to the lateral axis of the housing; wherein said bore is in fluid communication with a parallel channel and a transverse channel; wherein said transverse channel is oriented perpendicular to the longitudinal axis of the bore; said transverse channel being open at a top surface of said housing; said latch pawl slidingly disposed within said transverse channel.

8. The buckle of claim 1, wherein the bore defines a cylindrical opening with one closed end, said bore having a longitudinal axis oriented parallel to the lateral axis of the housing; wherein said bore is in fluid communication with a parallel channel and a transverse channel; wherein said transverse channel is oriented perpendicular to the longitudinal axis of the bore and open at a top surface of said housing; said latch pawl slidingly disposed within said transverse channel; the latch mechanism further comprising a spring to bias said latching mechanism.

9. The buckle of claim 1, wherein said male component further comprises a yoke having a frame and a transverse keeper bar; wherein said transverse keeper bar is spaced from and parallel to a vertical leg of the frame; said yoke defining a point of attachment to a web of material.

10. The buckle of claim 1, wherein said male component further comprises a yoke having a frame and a transverse keeper bar; wherein said transverse keeper bar is spaced from and parallel to a vertical leg of the frame; said yoke defining a point of attachment to a web of material; wherein said keeper element is attached to the yoke by a bridge element, the bridge element connected to the vertical leg of the frame and to the keeper element.

11. The buckle of claim 1, wherein said male component further comprises a yoke having a frame and a transverse keeper bar; wherein said transverse keeper bar is spaced from and parallel to a vertical leg of the frame; said yoke defining a point of attachment to a web of material; wherein said keeper element is attached to the yoke by a bridge element, the bridge element directly connected to the vertical leg of the frame and to the keeper element; and wherein said keeper element is a cylindrical member defining an angled face on a bottom end thereof.

12. The buckle of claim 1, wherein the bore is in fluid communication with a parallel channel and a transverse channel; wherein said parallel channel defines a slotted opening oriented parallel to the lateral axis of the housing; said parallel channel forming a slotted opening on the mating end of the housing; wherein said transverse channel has a plurality of shoulder areas vertically adjacent to one another, said plurality of shoulders providing the transverse channel with a step-like configuration.

13. The buckle of claim 1, wherein the bore defines a cylindrical opening with one closed end and a longitudinal axis oriented parallel to the lateral axis of the housing; wherein said bore is in fluid communication with a parallel channel and a transverse channel; wherein said transverse channel is oriented perpendicular to the longitudinal axis of the bore and open at a top surface of said housing; said latch mechanism comprising a latch pawl having a latching leg extending therefrom; said latch pawl slidingly disposed within said transverse channel; wherein said transverse channel has a plurality of shoulder areas vertically adjacent to one another, said plurality of shoulder areas providing the transverse channel with a step-like configuration; wherein said plurality of shoulder areas comprises a first shoulder located at an upper end of the transverse channel and adjacent to said top surface of said housing, said first shoulder limits movement of the pawl away from a mating end of said housing.

14. The buckle of claim 1, wherein the bore defines a cylindrical opening with one closed end and a longitudinal axis oriented parallel to the lateral axis of the housing; wherein said bore is in fluid communication with a parallel channel and a transverse channel; wherein said transverse channel is oriented perpendicular to the longitudinal axis of the bore and open at a top surface of said housing; said latch pawl slidingly disposed within said transverse channel; wherein said transverse channel has a plurality of shoulder areas vertically adjacent to one another, said plurality of shoulder areas providing the transverse channel with a step-like configuration; wherein said plurality of shoulder areas comprises a first shoulder located at an upper end of the transverse channel and adjacent to said top surface of said housing, said first shoulder limits movement of the pawl away from a mating end of said housing; said plurality of shoulder areas further comprising a second shoulder, said second shoulder being adjacent to the first shoulder, said second shoulder engages with a coil spring to bias the latch mechanism.

15. The buckle of claim 1, wherein the bore defines a cylindrical opening with one closed end and a longitudinal axis oriented parallel to the lateral axis of the housing; wherein said bore is in fluid communication with a parallel channel and a transverse channel; wherein said transverse channel is oriented perpendicular to the longitudinal axis of the bore and open at a top surface of said housing; said latch pawl slidingly disposed within said transverse channel; wherein said transverse channel has a plurality of shoulder areas vertically adjacent to one another, said plurality of shoulder areas providing the transverse channel with a step-like configuration; wherein said plurality of shoulder areas comprises a first shoulder located at an upper end of the transverse channel and adjacent to said top surface of said housing, said first shoulder limits movement of the pawl away from a mating end of said housing; said plurality of shoulder areas further comprising a second shoulder, said second shoulder being adjacent to the first shoulder, said second shoulder engages with a coil spring to bias the latch mechanism; said plurality of shoulder areas further comprising a third shoulder adjacent to said second shoulder, said third shoulder limits movement of the pawl away from the mating end of said housing.

16. The buckle of claim 1, wherein the bore defines a cylindrical opening with one closed end and a longitudinal axis oriented parallel to the lateral axis of the housing; wherein said bore is in fluid communication with a parallel channel and a transverse channel; wherein said transverse channel is oriented perpendicular to the longitudinal axis of the bore and open at a top surface of said housing; said latch pawl slidingly disposed within said transverse channel; wherein said transverse channel has a plurality of shoulder areas vertically adjacent to one another, said plurality of shoulder areas providing the transverse channel with a step-like configuration; wherein said plurality of shoulder areas comprises a first shoulder located at an upper end of the transverse channel and adjacent to said top surface of said housing, said first shoulder limits movement of the pawl away from a mating end of said housing; said plurality of shoulder areas further comprising a second shoulder, said second shoulder being adjacent to the first shoulder, said second shoulder engages with a coil spring to bias the latch mechanism; said plurality of shoulder areas further comprising a third shoulder adjacent to said second shoulder, said third shoulder limits movement of the latch pawl away from the mating end of said housing; said lateral channel further comprising a forward vertical wall in spaced relation to the third shoulder, said forward vertical wall limiting movement of said pawl toward said mating end of said housing.

17. The buckle of claim 1, wherein the bore defines a cylindrical opening with one closed end and a longitudinal axis oriented parallel to the lateral axis of the housing; wherein said bore is in fluid communication with a parallel channel and a transverse channel; wherein said transverse channel is oriented perpendicular to the longitudinal axis of the bore and parallel to the longitudinal axis of the housing and open at a top surface of said housing; said latch pawl slidingly disposed within said transverse channel; said actuator facilitates movement of said latching pawl against the bias of a spring and away from the mating end of said housing.

18. The buckle of claim 1, wherein the bore defines a cylindrical opening with one closed end, said bore having a longitudinal axis oriented parallel to the lateral axis of the housing; wherein said bore is in fluid communication with a parallel channel and a transverse channel; wherein said transverse channel is oriented perpendicular to the longitudinal axis of the bore and open at a top surface of said housing said latch pawl slidingly disposed within said transverse channel; said latch pawl being affixed within said lateral channel by a pair of pins disposed within respective slots in the latch pawl.

19. The buckle of claim 1, wherein said latching leg defines a rounded upper surface; wherein said rounded upper surface facilitates the acceptance of the elongated keeping member into the bore.

20. The buckle of claim 1, wherein the bore defines a cylindrical opening with one closed end, said bore having a longitudinal axis oriented parallel to the lateral axis of the housing; wherein said bore is in fluid communication with a parallel channel and a transverse channel; wherein said transverse channel is oriented perpendicular to the longitudinal axis of the bore and open at a top surface of said housing; said latch pawl slidingly disposed within said transverse channel; said latch pawl being affixed within said lateral channel by a pair of pins disposed within respective slots in the latch pawl; wherein said latching leg defines a rounded upper surface, said rounded upper surface facilitates the acceptance of the elongated keeping member into the bore; said actuator facilitates movement of said latching pawl against the bias of a spring and away from the mating end of said housing.

* * * * *